US011053698B2

(12) United States Patent
Ueblacker et al.

(10) Patent No.: US 11,053,698 B2
(45) Date of Patent: Jul. 6, 2021

(54) FORMWORK ELEMENT WITH SIGNAL MODULE FOR TRANSMITTING SEPARATING AGENT CONTENT OF A SEPARATING AGENT RESERVOIR LAYER

(71) Applicant: Smartering GmbH, Amstetten (AT)

(72) Inventors: Dietmar Ueblacker, Winklarn (AT); Rudolf Mayerhofer, Ferschnitz (AT); Andreas Dirnberger, Amstetten (AT)

(73) Assignee: Smartering GmbH, Amstetten (AT)

( * ) Notice: Subject to any disclaimer, the term of this patent is extended or adjusted under 35 U.S.C. 154(b) by 0 days.

(21) Appl. No.: 16/489,714

(22) PCT Filed: Mar. 2, 2018

(86) PCT No.: PCT/EP2018/055177
§ 371 (c)(1),
(2) Date: Aug. 29, 2019

(87) PCT Pub. No.: WO2018/158432
PCT Pub. Date: Sep. 7, 2018

(65) Prior Publication Data

US 2020/0248465 A1 Aug. 6, 2020

(30) Foreign Application Priority Data

Mar. 2, 2017 (AT) ..... A 78/2017

(51) Int. Cl.
*E04G 9/05* (2006.01)
*E04G 9/10* (2006.01)
(Continued)

(52) U.S. Cl.
CPC ..... *E04G 9/05* (2013.01); *B28B 7/0005* (2013.01); *E04G 9/10* (2013.01); *E04G 9/06* (2013.01);
(Continued)

(58) Field of Classification Search
CPC ..... E04G 9/10; E04G 9/05; B28B 7/0005
(Continued)

(56) References Cited

U.S. PATENT DOCUMENTS 3,468,690 A * 9/1969 Hemming ..... C08G 18/00 428/318.4
3,844,527 A * 10/1974 Scott ..... E04G 9/10 249/189
(Continued)

FOREIGN PATENT DOCUMENTS

AT 515 391 B1 8/2016
DE 10 2008 000381 A1 8/2009
(Continued)

OTHER PUBLICATIONS

International Search Report and Written Opinion received in PCT application No. PCT/EP2018/05517, dated May 11, 2018, 14 pages (including English Translation).
(Continued)

*Primary Examiner* — Michael Safavi
(74) *Attorney, Agent, or Firm* — FisherBroyles, LLP

(57) ABSTRACT

A formwork element has a theft protection, wherein a base layer is applied onto at least one surface of the formwork element, and wherein at least one signal module for communication with at least one base station is provided. The base layer being designed in a water-tight manner, and an at least partially porous concrete-repellent separating layer is provided above the base layer.

7 Claims, 2 Drawing Sheets

Figure 1:
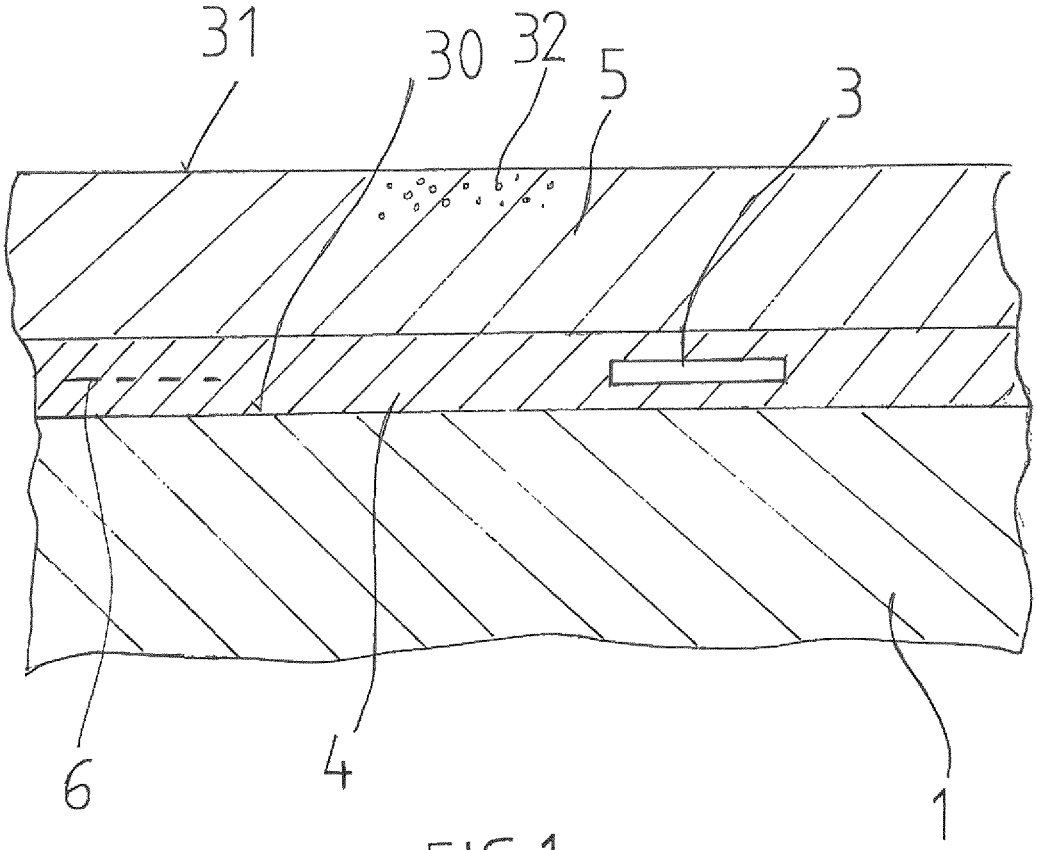

(51) Int. Cl.

| | |
|---|---|
| ***B28B 7/00*** | (2006.01) |
| *E04G 9/06* | (2006.01) |
| *E04G 17/00* | (2006.01) |
| *E04G 9/02* | (2006.01) |

(52) U.S. Cl.
CPC ..... *E04G 17/00* (2013.01); *E04G 2009/025* (2013.01); *E04G 2009/028* (2013.01)

(58) Field of Classification Search
USPC ..... 264/213
See application file for complete search history.

(56) References Cited

U.S. PATENT DOCUMENTS

| | | | | |
|---|---|---|---|---|
| 3,958,790 | A * | 5/1976 | Scott | B28B 7/12 249/65 |
| 2019/0308342 | A1* | 10/2019 | Butler | B28C 5/06 |

FOREIGN PATENT DOCUMENTS

| | | | | |
|---|---|---|---|---|
| DE | 10 2009 036310 | A1 | 4/2010 | |
| EP | 1 647 651 | A2 | 4/2006 | |
| GB | 2553584 | A * | 3/2018 | C04B 2103/54 |
| KR | 1020180112219 | A * | 3/2020 | E04G 9/10 |
| WO | 02/18212 | A2 | 3/2002 | |
| WO | WO-2018130913 | A2 * | 7/2018 | E04G 21/0436 |

OTHER PUBLICATIONS

International Preliminary report on Patentability received in PCT application No. PCT/EP2018/05517, dated Sep. 6, 2019, 15 pages (including English Translation).

* cited by examiner

FORMWORK ELEMENT WITH SIGNAL MODULE FOR TRANSMITTING SEPARATING AGENT CONTENT OF A SEPARATING AGENT RESERVOIR LAYER

CROSS-REFERENCE TO RELATED APPLICATION

This application is a National Stage application of International Application No. PCT/EP2018/055177, filed Mar. 2, 2018, which claims priority to Austrian Application No. A 78/2017, filed Mar. 2, 2017, which are incorporated by reference herein in their entireties.

BACKGROUND

Field

The invention relates to a formwork element having a theft protection.

Description of the Related Art

In the context of the invention, formwork elements are understood to be all components used for formwork construction, such as formwork panels or shuttering panels, but also supports or steel frame elements or the like.

For example, formwork panels or shuttering panels consist of multilayer glued plywood and are used for the construction of formwork in concrete construction, where they have to withstand the pressure of the concrete/cement mixture until it hardens. To protect the surface of the formwork elements, it will be impregnated or sealed.

Since the number of formwork elements in use on construction sites is constantly changing depending on the construction phase, monitoring can only be carried out at great expense. At the same time, harsh environmental conditions prevail on construction sites and certain areas are difficult to see or are shielded by thick walls, so that loss or deliberate interchanging of formwork elements of different quality occurs again and again.

Already known solutions provide for the attachment of transponders to or inside the formwork elements, which can be read out actively or passively via a reading unit. However, such transponders can only achieve a very small range, so that large-area monitoring cannot be carried out.

SUMMARY

The invention relates to a formwork element having a theft protection, wherein a base layer is disposed onto at least one surface of the formwork element, and wherein at least one signal module for communicating with at least one base station is provided.

The purpose of the invention is therefore to specify a formwork element that is equipped with effective anti-theft protection for harsh environmental conditions and is protected against circumvention of the anti-theft protection, whereby at the same time there should also be a contact surface between the concrete and the formwork element enabling easy demolding.

A further task is to enable simplified maintenance and inspection of the formwork elements in order to maintain the surface properties of the formwork element over a long period of time in a constant quality.

According to the invention, this is achieved by the fact that the base layer is watertight and that above the base layer an at least partially porous, concrete-repellent separating layer is provided.

The signal module which can be connected to at least one base station is, for example, embedded in the base layer, the base layer applied to the surface of the formwork element protecting the signal module from external mechanical influences and against access. A signal module is defined as a module which is based on an electromagnetic signal transmission method, e.g. a radio transmission method, and is equipped with its own power supply.

The base layer can surround the entire formwork element or only partial areas, e.g. only one side surface, can be coated with the base layer.

Since the base layer according to the invention is waterproof, the signal module is protected against the effects of moisture and against manipulation. The base layer is firmly attached to the surface of the formwork element and carries the porous separating layer on its side facing away from the formwork element, which creates a smooth surface with regard to the concrete surface to be formed, which can be easily separated from the concrete after curing.

In order to ensure that the concrete adheres as little as possible to the outer surface of the formwork element during the production of the concrete component by the formwork element and thus allowing as complete a demolding as possible, the separating layer is designed to be concrete-repellent.

It is important to emphasize that the combination of a porous separating layer, which also represents an advantageous smooth surface for the formwork element with regard to the concrete surface to be formed, and the waterproof base layer underneath, which protects the signal module against moisture and manipulation, allows both good traceability and monitoring of the formwork element according to the invention and easy demolding of the formwork element after the concrete has cured.

According to another example of the invention, for the management, caching of data and acquisition of physical quantities in the area of the formwork element, it may also be envisioned that printed circuits and/or sensors be formed inside the base layer, which are covered by or embedded in the base layer and which are connected to the signal module.

In a further implementation of the invention, a separating agent reservoir layer may be formed between the base layer and the separating layer, in which a separating agent, e.g. separating oil, is stored for release to the separating layer. The separating agent reservoir layer can, for example, comprise a paper or fiber web in which the separating agent can be stored.

In this context, a further embodiment of the invention may comprise the signal module having a sensor input which is connected to a sensor for measuring the separating agent content of the separating agent reservoir layer. Without limitation, the measurement can be carried out, e.g. by a capacitive or resistive sensor.

The separating agent content monitored by the signal module can be continuously read out by the base station in order to initiate maintenance of the formwork element with renewed impregnation with separating agent, if the separating agent content drops.

In another embodiment of the invention, a printed circuit comprising the signal module and a power supply may be provided within the separating agent reservoir layer or the base layer, so that the printed circuit having a signal module and associated power supply are enclosed and protected against manipulation.

In another implementation, the printed circuit may include a sensor housed in or within the region of the separating layer or separating agent reservoir layer to detect the separating agent content.

In addition, the printed circuit board may include conductor paths and/or antennas that may be construed for the signal and power lines of the signal module and for connection to the antenna, thus providing a simple method of fabrication.

A further embodiment of the invention may consist of the fact that the base layer and/or separating layer is transparent and that a legible or machine-readable imprint is formed in the base layer or separating layer, or between the base layer and the separating layer, allowing for identification of the formwork element.

According to another implementation of the invention, the separating layer can be an epoxy resin layer whose pore content can be adjusted very precisely for the purpose of absorbing the separating agent.

In a preferred embodiment of the invention, the use of radio technology, which works remotely, is envisioned so that the signal modules built into the formwork elements can be read out remotely, within a radius of 100 to 300 m, so that central management and monitoring can be carried out in an advantageous way.

In this context it can be envisaged that the signal module includes a chip with radio technology, preferably LoRaWAN technology having an independent voltage source. In particular, the LoRaWAN protocol has proven to be very advantageous for the purposes of monitoring and managing formwork elements in accordance with the invention.

Preferably, the imprint on the formwork element can be a readable or machine-readable imprint, e.g. a barcode, so that the information contained in the imprint can easily enable the respective formwork element to be assigned to a specific series or origin.

For easier and better readout, the separating layer and the base layer can preferably be transparent.

According to another variant of the invention, the imprint can be formed by a printed circuit or by electrically conductive layers, which can be designed as conductor paths or antennas. Thus, a printed circuit, which can be connected to the signal module, can be disposed onto the surface of the formwork element, which is protected against external influences and manipulation by the base layer applied over it. However, such a printed circuit can also be formed within the base layer.

Without limitation, the base layer can be formed of any suitable plastic materials which allow for a waterproof protection of the anti-theft measures, such as imprint and signal module, located in or on the formwork element by gluing or encapsulating the surface, and which provide a good connection, i.e. no detachment.

According to a further embodiment of the invention, the base layer can be a waterproof plastic layer.

According to another exemplary embodiment of the invention, an imprint can be provided on the formwork element in accordance with the invention, e.g. on a part of a side surface of the formwork element, which is protected against external influences and manipulation by the base layer and separating layer disposed above it and, if necessary, the separating agent reservoir layer, so that a serial number or the origin of the formwork element can be determined at any time with a suitable imprint. The imprint itself may have other properties, such as electrical conductivity, sensory properties, etc. The imprint can also be used for other purposes. Due to the base layer inseparably bonded with the formwork element, the imprint can only be interfered with if the formwork element is destroyed and therefore no changes can be made to the information contained in the imprint.

According to another exemplary embodiment, the signal module can comprise a chip with radio technology, preferably LoRaWAN technology, having an independent voltage source. The charge of such an independent voltage source is sufficient for the entire lifetime of the formwork element. Other types of signal modules can also be used, provided they are suitable for the intended purpose of electromagnetic signal transmission.

With the well-known LoRaWAN network technology, for example, all signal modules on a construction site can be monitored by formwork elements designed according to the invention and located within the radio range of the associated base station. For example, the LoRaWAN network may be installed in a star shape, i.e. the base station will be installed centrally on the construction site and there are signal modules which are attached to the formwork elements to be monitored and which communicate with the base station in real time. The base station automatically detects all signal modules in the radio range and sends their status, e.g. alarm ON or OFF, GPS position, temperature, humidity etc., to an internet server in real time.

BRIEF DESCPRIPTION OF THE DRAWINGS

Figure 2:
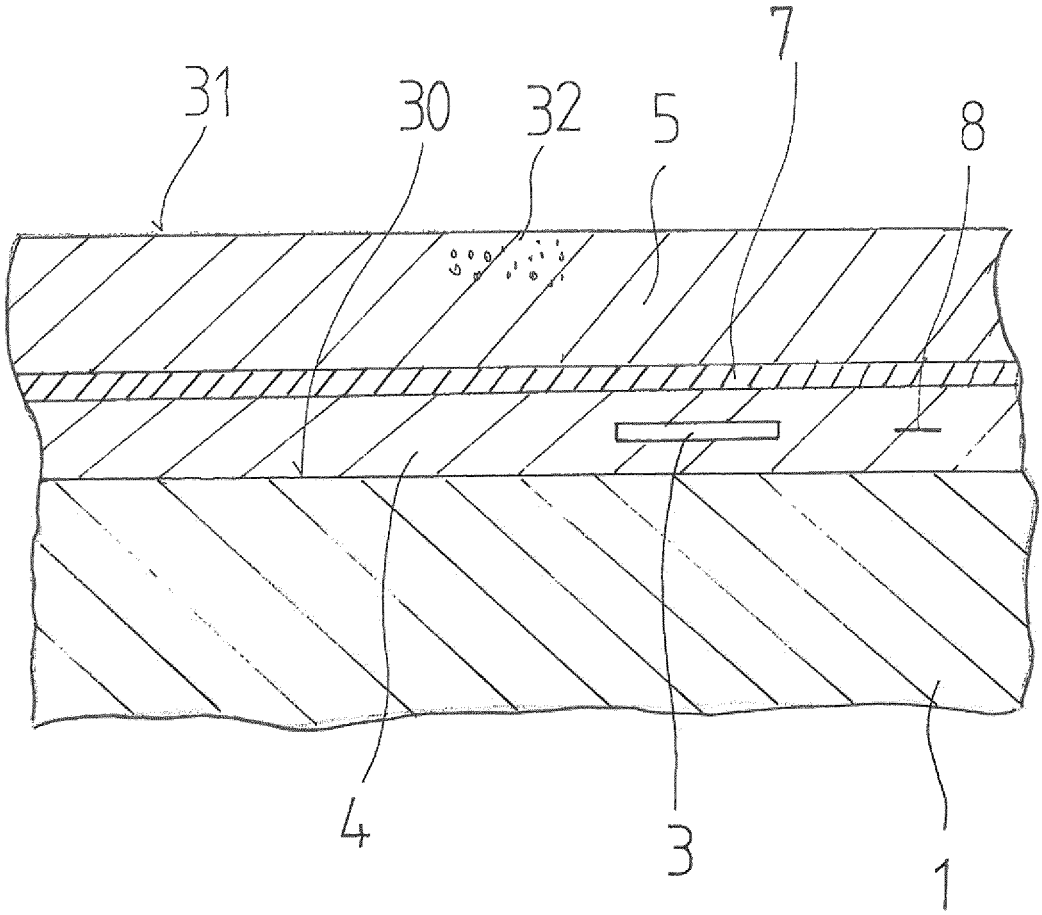

In the following, the invention is explained in detail on the basis of the exemplified embodiments shown in the drawings without limiting the generality of the inventive idea. In the figures:

FIG. 1 shows a partial section through one embodiment of the formwork element according to the invention; and FIG. 2 shows a partial section through another embodiment of the formwork element according to the invention;

DETAILED DESCRIPTION

FIG. 1 shows a rectangular formwork element in the form of a formwork panel 1 for a formwork in concrete construction, which can, for example, be formed from several layers of glued plywood panels. Formwork elements also include other elements for formwork structures, such as columns, frame elements or formwork elements made of metal, plastic or the like.

Within the scope of the invention, there is no limitation with regard to the type of construction, the choice of materials and the geometric design of formwork elements; rather, the invention can be applied to all types of formwork elements.

All features generally described for the formwork panel 1 are generally applicable to all formwork elements.

A base layer 4 is disposed on a surface 30, e.g. a top surface, of formwork element 1, in which a signal module 3 is provided for communication with at least one base station (not shown).

In accordance with the invention, the base layer 4 is waterproof, e.g. made of a waterproof plastic, in which the signal module 3 is incorporated, e.g. by being cast into the base layer 4. In this way, the signal module 3 is protected against moisture penetration and manipulation.

The signal module 3 is equipped with an independent voltage supply which is also included in the base layer 4.

According to the invention, in order to achieve good separation properties, an at least partially porous, concrete-repellent separating layer 5 is provided above the base layer 4, i.e. on the side of the base layer facing away from the formwork panel 1, whereby pores 32 are preferably designed in such a way that they can accommodate a separating agent, e.g. a separating oil or separating wax, which enables simple and clean demolding.

The separating layer 5 is concrete-repellent and comes into contact with a concrete or cement mixture during the construction of the respective construction section and there is practically no adhesion of the finished concrete.

The separating layer 5 can be made of any suitable plastic, monoplastic, thermoset, resin, etc., preferably it consists of an epoxy resin layer which is very suitable for concrete construction purposes and provides very smooth concrete surfaces.

The separating layer 5 preferably expands over the entire base layer 4 of formwork panel 1, i.e. side surfaces and end faces, and forms a smooth surface 31 compared to the hardening concrete. Due to the pores 32 present in the separating layer 5, the separating agent present in these pores can escape to the smooth surface 31 in order to enable improved separating properties compared to the hardened concrete. After several demolding processes, more of the separating agent can diffuse from the separating agent reservoir layer 7 into the separating layer 5 to replace the already used separating agent. As soon as there is no longer sufficient separating agent in the separating agent reservoir layer 7, this can be reported via the signal module 3, whereupon the formwork element needs to be serviced.

The separating layer 5 is, for example, formed by an epoxy resin layer of approx. 2 mm, the pores 32 of which are impregnated with a separating oil, whereby the separating agent is stored within the separating layer 5 and the separating agent emerges from the pores 32 when a concrete surface is formed on the outside of the separating layer 5, i.e. on the side of the separating layer 5 facing away from the base layer 4, and can take full effect.

Signal module 3 contains a chip using LoRaWAN technology with an independent voltage source. However, signal module 3 can also use other forms of radio signal transmission or other electromagnetic transmission. For position determination the signal module 3 comprises a position sensor or a position sensor is connected to the signal module 3 at another position on the formwork panel 1. In this way, the position of panel 1 can be constantly monitored and a theft alarm can be activated in the event of an unauthorized change of position.

When the base layer 4 is applied, the signal module 3 is molded within it.

On one hand, his provides protection against mechanical and chemical impact and effectively prevents any manipulation of the signal module 3 on the other. In order to reach the signal module 3, the formwork panel 1 would have to be destroyed.

In addition to signal module 3, printed circuits and/or sensors (not shown) are provided on or in panel 1, which are covered by or embedded in the base layer 4 and which are connected to the signal module 3.

The sensors can, for example, be position, location, acceleration, pressure, light, vibration sensors, etc. whose output signals are transmitted to the base station via signal module 3.

Swelling tests with panel 1 immersed in water have shown that the signal module 3 and the embedded printed circuits and sensors are sufficiently protected against moisture by the base layer 4.

Furthermore, the base layer 4 and the separating layer 5 are transparent, with a readable or machine-readable imprint 6 having been formed in the base layer 4, which serves to identify the formwork panel 1.

The imprint 6 is designed as a readable or machine-readable imprint, e.g. a number, a logo, a barcode, so that the imprint can be read through the plastic layer. The imprint 6 may also be provided in the separation layer 5 or between the separation layer 5 and the base layer 4.

The imprint 6 may be placed at different depths by producing base layer 4 or interface layer 5 by forming sublayers and then depositing imprint 6 to one of the sublayers and covering it with the subsequent sublayer.

FIG. 2 shows another embodiment of the formwork element in accordance with the invention, wherein additionally a separating agent reservoir layer 7 is formed between the base layer 4 and the separating layer 5.

For example, the separating agent reservoir layer 7 may be embodied as a paper or fiber web in which a separating agent is stored, which is first introduced into the separating agent reservoir layer 7 by impregnation from the outside via the separating layer 5, before being gradually released again from this into the separating layer 5 via the diffusion path.

In the exemplary embodiment according to FIG. 2, an additional imprint 8 is provided which is formed by a printed circuit connected to a radio unit mounted at another location and which is secured against forgery by the plastic layer arranged above it. Instead of or in addition to the printed circuit board, a flat sensor which is electrically connected to the signal module can also be embedded in the base layer 4 in order to transmit physical measured values to the base station by means of the signal module.

The signal module 3 has a sensor input which is connected to a capacitive sensor (not shown) for measuring the separating agent content of the separating agent reservoir layer 7. In this way, the filling level of separating agent within the separating layer 7 can be detected and read out via signal module 3, so that if the separating agent content is too low, the formwork element is re-impregnated in order to maintain the separating properties of the separating layer in excellent condition at all times.

Signal module 3 is arranged in the base layer 4, as shown in FIG. 2, but could also be arranged in the separating agent reservoir layer 7, or could extend across the base layer 4 and the separating agent reservoir layer 7.

Furthermore, the imprint 8, which is applied, e.g. by screen printing, can be implemented by electrically conductive layers, which are designed as conductor paths or antennas, whereby corresponding connections can be created with the signal module and an antenna imprinted on the control panel.

What is claimed is:

1. A formwork element comprising anti-theft protection, the formwork element comprising:

a base layer forming at least one surface of the formwork element, the base layer being watertight;

at least one signal module configured to communicate with a base station;

an at least partially porous, concrete-repellent separating layer disposed above the base layer, the separating layer comprising a smooth surface configured to face towards hardening concrete, the separating layer comprising pores formed such that the pores take up a separating agent emerging on the smooth surface, thereby allowing simple and clean demolding; and a separating agent reservoir layer disposed between the base layer and the separating layer, the separating agent being stored in the separating agent reservoir layer and delivered to the separating layer, the separating agent reservoir layer being formed such that, after some demolding events, more separating agent can continue to diffuse from the separating agent reservoir layer into the separating layer to replace the separating agent that was consumed, the signal module comprising a sensor input connected to a capacitive sensor that measures a content of the separating agent within the separating agent reservoir layer, thereby enabling detection of a filling level of the separating agent within the separating agent reservoir layer and reading out of the filling level of the separating agent within the separating agent reservoir layer via the signal module so that, in response to the separating agent content becoming too low, the formwork element is re-impregnated to maintain separating properties of the separating layer.

2. The formwork element according to claim 1, wherein a printed circuit comprising the signal module and a power supply is disposed inside the separating agent reservoir layer or the base layer so that the printed circuit comprising the signal module and power supply is enclosed and protected against manipulation.

3. The formwork element according to claim 2, wherein the printed circuit comprises a sensor disposed in the separating layer configured to be disposed adjacent to the hardening concrete.

4. The formwork element according to claim 2, wherein the printed circuit comprises conductor paths and/or antennas.

5. The formwork element according to claim 1, wherein the base layer-and/or the separating layer are transparent, and a legible or machine-readable imprint is formed in the base layer or in the separating layer or between the base layer and the separating layer.

6. The formwork element according to claim 1, wherein the separating layer is an epoxy resin layer.

7. The formwork element according to claim 1, wherein the signal module comprises a chip with electromagnetic signal transmission technology and an independent voltage source.

* * * * *